United States Patent [19]

Hollister, Jr.

[11] Patent Number: 4,875,514

[45] Date of Patent: Oct. 24, 1989

[54] WOOD SPLITTING METHOD AND APPARATUS

[76] Inventor: Graham Hollister, Jr., P.O. Box 218, Genoa, Nev. 89411

[21] Appl. No.: 261,637

[22] Filed: Oct. 24, 1988

[51] Int. Cl.[4] ..... B27L 7/00; B27M 1/08

[52] U.S. Cl. ..... 144/367; 144/3 K; 144/193 A; 144/366; 144/193 E

[58] Field of Search ..... 144/3 K, 193 R, 193 A, 144/367, 366, 193 D, 193 E

[56] References Cited

U.S. PATENT DOCUMENTS

| | | | |
|---|---|---|---|
| 4,219,057 | 8/1980 | Falk | 144/192 |
| 4,269,242 | 5/1981 | Smith et al. | 144/192 |
| 4,371,019 | 2/1983 | Jeffrey | 144/3 K |
| 4,478,263 | 10/1984 | Johnston | 144/3 K |
| 4,782,866 | 11/1988 | Valdez | 144/193 A |

FOREIGN PATENT DOCUMENTS

| | | | |
|---|---|---|---|
| 1028933 | 4/1978 | Canada | 144/3 K |
| 1097193 | 3/1981 | Canada | 144/193 A |
| 3606194 | 8/1987 | Fed. Rep. of Germany | 144/193 A |

*Primary Examiner*—W. Donald Bray
*Attorney, Agent, or Firm*—Herbert C. Schulze

[57] ABSTRACT

A method and an apparatus for performing said method wherein a log of wood is split by being forced through a generally conical shaped apparatus containing a multiplicity of uniquely shaped, spaced, interconnected, and cooperatively operative knives or splitting elements. The method involves forcing a large log of wood through the uniquely shaped knife or splitting element arrangement in such manner that there is in effect a stepped splitting of the wood into relatively uniformly shaped pieces of wood suitable to be used for a variety of purposes including, but not limited to, firewood, and the like.

5 Claims, 4 Drawing Sheets

FIG. 1.
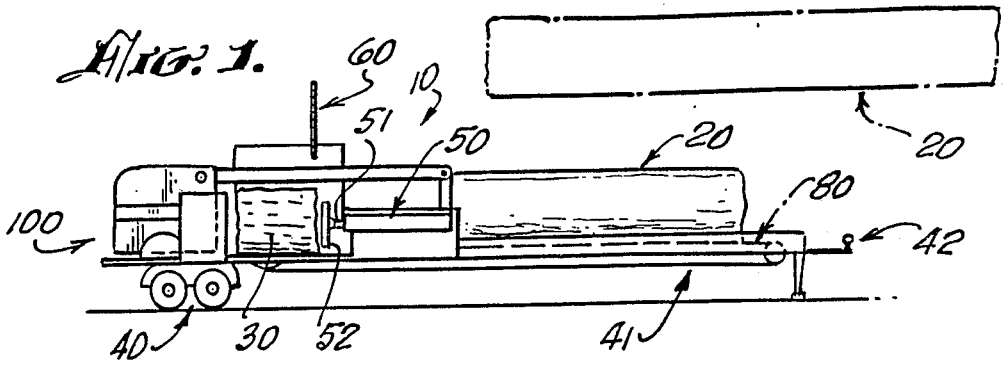
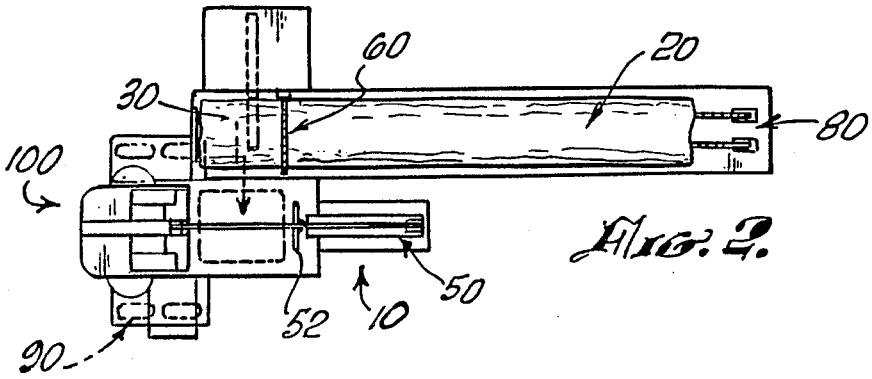
FIG. 2.
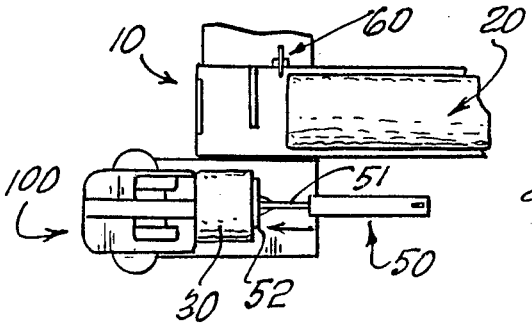
FIG. 3.
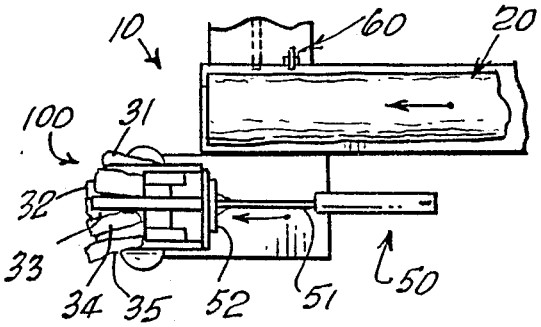
FIG. 4.

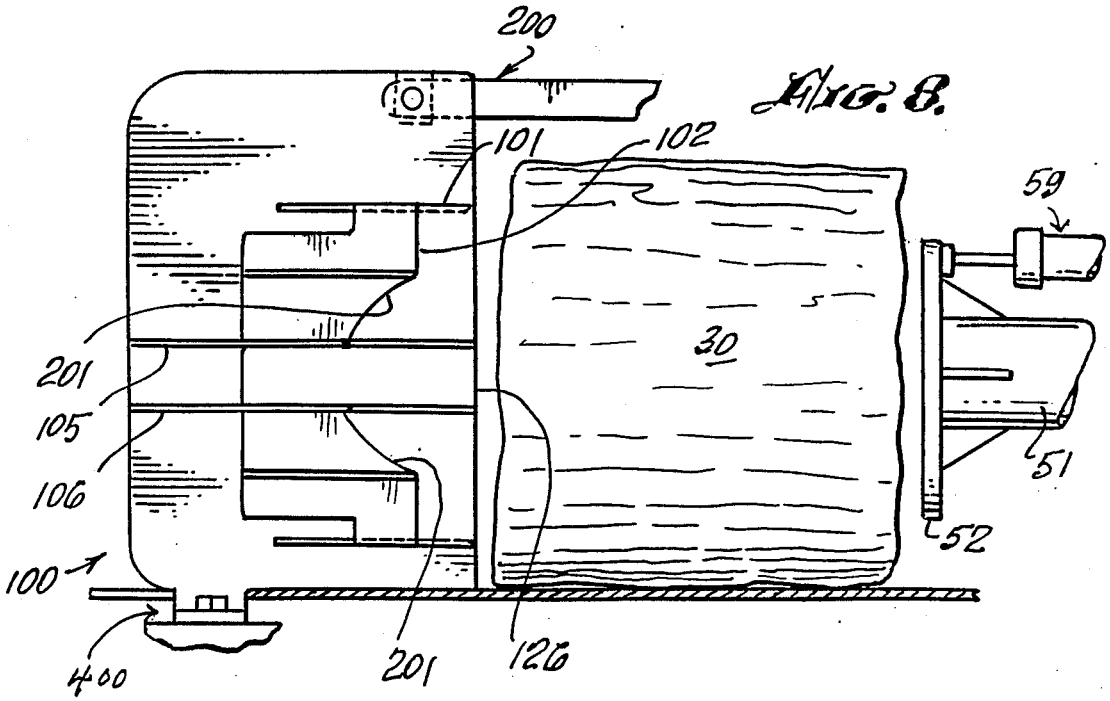
FIG. 8.
FIG. 11.
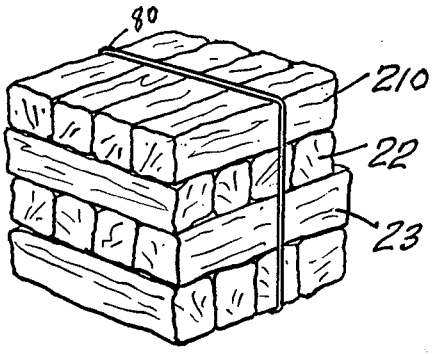
FIG. 10.
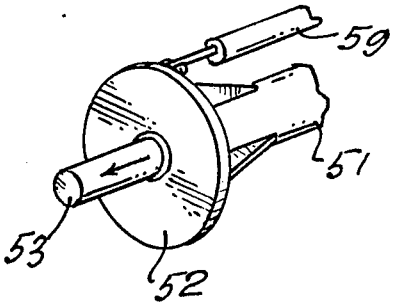
FIG. 9.
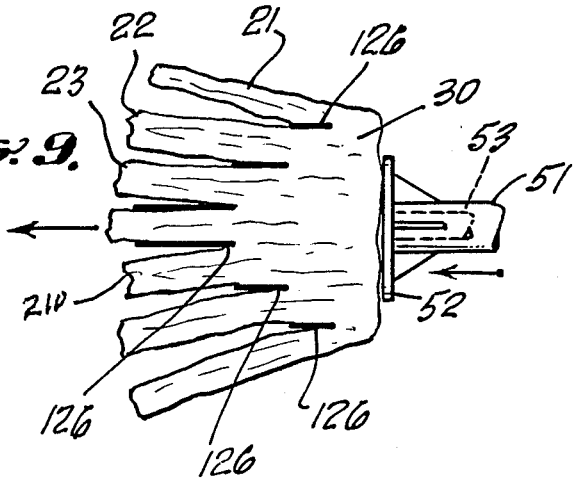

WOOD SPLITTING METHOD AND APPARATUS

CROSS REFERENCE TO RELATED PATENT APPLICATIONS

There are no patent applications related to this application filed by me.

BACKGROUND OF THE INVENTION

1. FIELD OF THE INVENTION

This invention is in the general field of splitting or shaping of logs of wood into smaller pieces of wood;

The invention is even more particularly directed to a method and apparatus for forcing a log of wood through a specially formed and designed series of knives or wood splitting elements in such manner that the shape and uniformity of the pieces of log being split remain relatively constant or in a constantly conformed pattern of size and shape;

The invention is even more particularly related to a method and apparatus for performing the method as set forth wherein the constant shape and size of the wood being split is accomplished by partially splitting each log through a series of different areas in order that proper relief is afforded to the wood being split so it does not jam, or deform unduly in passing through a series of offset knives or splitting elements.

2. DESCRIPTION OF THE PRIOR ART

Wood splitting by the forcing of a wedge or the like through a log held in place, or conversely forcing the log past a wedge or the like held in place, wherein a log is divided into two or more parts is known and practiced, particularly for making firewood.

All such devices known to me heretofore made to operate in this manner, known to me, produce random sizes and shapes of logs suitable, in general, for burning as firewood.

The method and apparatus of this invention, while using the theory of forcing wood past a splitting element, is completely different in its uniqueness and innovativeness as well as its utility in that the wood which is split by the method and apparatus of this invention has a uniformity and conformity of sizes and shapes of pieces which are produced which is unknown and unheard of heretofore in connection with splitting of wood as opposed to sawing wood in a sawmill or the like, particularly wherein the method of cutting the wood is by splitting in and through a series of offset and appropriately shaped splitting devices which cause a splitting of the log in a series or sequential number of passes through offset splitting elements without the necessity of interruption between such steps and particularly wherein large logs may be successfully split in this manner with relatively small forces being applied, and wherein the split pieces are relatively uniform in size for maximum ease and efficiency of storage and transport. There is no other system known to me using the unique theory herein described.

SUMMARY OF THE INVENTION

In the processing of wood for various purposes, one important and widely practiced process is the process of splitting logs of wood for purposes of use for firewood in fireplaces, wood burning stoves, and the like.

As is known to most of those skilled in the art, such processing for firewood use may be comprised of as simple a process as standing a log on end and striking it with an axe or a maul to split it.

Outside of this type hand splitting of wood, the next method of splitting wood is a single wedge or the like fastened to an hydraulic ram or the like and forced against the end of a log held in place by an appropriate mechanism. In this manner the log is also split in such manner as the wedge or the like may strike the log and it will normally split along natural lines of the growth of that particular log such as variations in the grain, knots and the like. The result is always unevenness of the exact individual split of wood, as compared to other similar splits made by the same equipment.

A variation of a simple splitting wedge or the like has been the development of series of radiating wedges which may, in one pass of an hydraulic ram or the like, result in two or more pieces of wood suitable for firewood.

Those familiar with the art recognize that the wood formed by the methods commonly known and used and as briefly described above, are uneven and result in ineffective use of storage space as well as sometimes difficulty in storing. Additionally such split pieces frequently are fractured in such manner that their edges are shredded or otherwise rough and difficult to handle.

It is also recognized that it is not possible by such methods to produce uniformly sized pieces of wood which may be "boxed" (that is produced so a number of pieces may be fastened to form a box like parcel).

I have studied this situation at length and have determined that one of the principal reasons why wood split in the manner heretofore described is not uniform and may result in great lack of uniformity together with the shredding and other characteristics along the edges as mentioned is that the wood is forced by its splitting elements to move in whatever direction may be most convenient and in accordance with the grain or other characteristics of the wood being split.

I have found that most of this is because of the immediate release of pressure, where great pressure is being applied, and a rapid extension of splitting along the natural wood grain lines or the like.

After considerable thought and considerable experimentation and study of the characteristics of wood I have conceived and developed a method and apparatus by which wood may be split utilizing hydraulic or other force means and yet ending up with individual pieces of wood of relatively uniform size and shape, making for easy stacking and storage as well as providing wood which can be "boxed" and the like. Further, I have found that by the methods I have developed much smaller pressures, and thus less expensive and cumbersome equipment can be utilized to accomplish the splitting and forming of the wood as heretofore set forth as being desirable.

The fundamental principle by which my method and apparatus works is the principle of segmenting, or sequentially applying, the pressure of the knives or splitting elements to the wood in staggered segments through specially constructed machinery, with specially constructed and shaped knives or splitting elements to accomplish the desired ends.

I accomplish this through a conical like arrangement, where during each sequential step, a portion of the wood will be split into the desired shape and size followed by different portions being so shaped and split and wherein the pressures throughout the entire log are gradually relieved such that it is possible for the shaping elements to properly shape the log without having to overcome and be influenced by the natural grain or other characteristics of the wood under the high pressure being applied. This method can be compared to an exfoliation, such as occurs where stone or the like will flake off under pressures of the earth.

It is an object of this invention to provide an improved method and means for splitting wood by the use of wood splitting elements;

Another object of this invention is to provide such a method and apparatus as has been described wherein wood may be split from a log in sequential steps resulting in a uniformity of the size as well controllability of the shape of the individual pieces of wood split from the log;

Another object of this invention is to provide such a method and apparatus as has been described where a minimum of force may be required to accomplish a maximum of work.

The foregoing and other objects and advantages of this invention will become apparent to those skilled in the art upon reading the following description of a preferred embodiment in conjunction with a review of the appended drawings.

BRIEF DESCRIPTION OF THE DRAWINGS

FIG. 1 is a side elevation of a complete mechanism for practicing the method of this invention;

FIG. 2 is a top elevation of the mechanism as shown in FIG. 1;

FIG. 3 is an illustration of a piece of wood (timber) which has been cut and is about to be forced into the cutting elements;

FIG. 4 illustrates from the top elevation the action of splitting of the wood;

FIG. 8 is a further enlarged side elevation showing a log about to be pushed through the cutting elements;

FIG. 9 shows the action of the wood being forced through the cutting element;

FIG. 10 illustrates an alternate embodiment of the hydraulic ram being used to push the wood through the cutting elements;

FIG. 11 shows the finished product "boxed";

DESCRIPTION OF A PREFERRED EMBODIMENT

Figure 5:
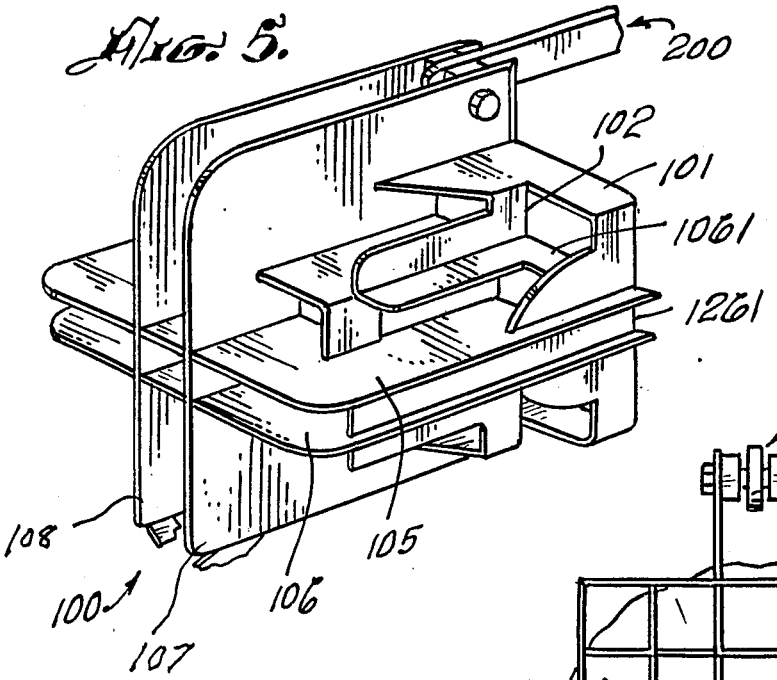
FIG. 5 is an enlarged perspective of the cutting element suitable to practice the method of this invention.

FIGS. 1, 2, 3 and 4 provide a brief schematic drawing showing the sequence of steps in operation of this invention.

FIG. 1 is a side elevation of a trailer generally 10 having wheels 40, a trailer hitch 42 at one end, and a trailer bed 41 with a chain carrying device 80 to support and move log 20 forward. A swiveling chain saw 60 is provided, which cuts a portion 30 of the log 20 which is then forced by hydraulic cylinder 50 and cylinder rod 51 with backup plate 52 into the cutting head 100. Power means 90 will be provided to power the chain saw, the hydraulic cylinder and the chains 80 in a manner known to those skilled in the art. A lever, or lever arm, 11 will move the log portion 30 into position to be advanced by the hydraulic ram after it has been cut. In FIG. 4 it is particularly shown how the pieces of wood 31, 32, 33, 34, 35, and other pieces, not visible, are ejected from the cutting edge in such manner that they do not interfere with one another.

Figure 6:
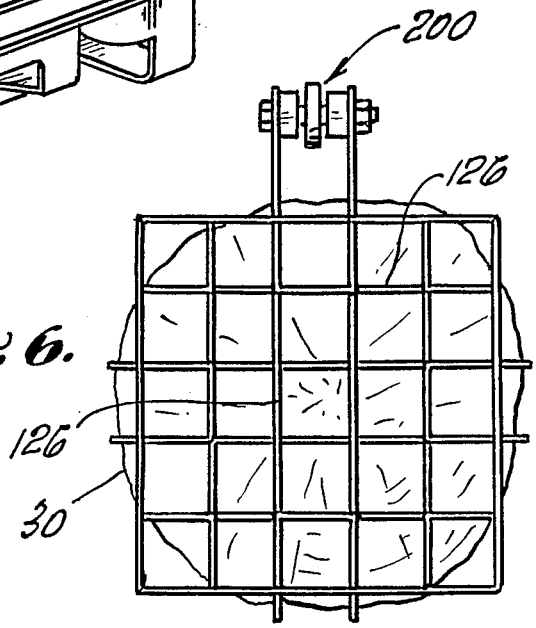
FIG. 6 is rear end elevation of the cutting element of FIG. 5.
Figure 7:
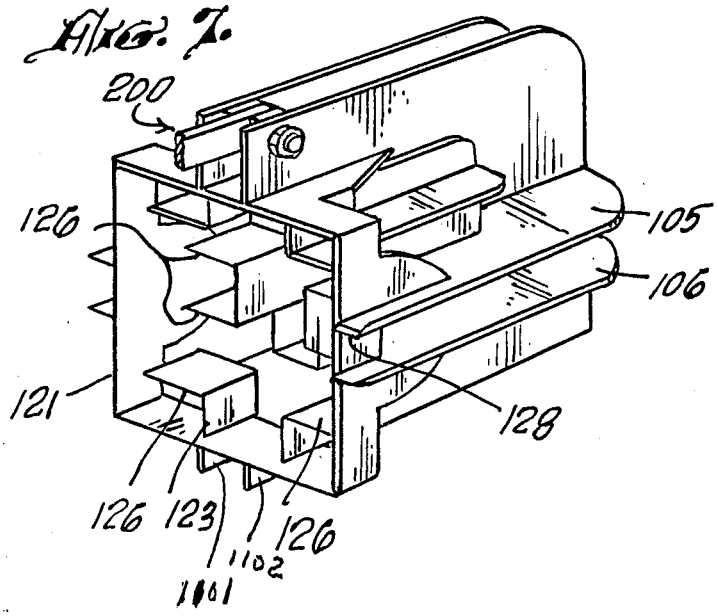
FIG. 7 is perspective from the front of the cutting element of FIG. 5.

FIGS. 5, 6 and 7 viewed together show the basic fundamental framework of plate 108 and 107, 106 and 105 which are welded together in such manner as to create the fundamental frame of the overall cutting device 100.

Since great pressures are applied, this device is fastened by welding, or by bolts, or the like to the trailer element at plate 1101 and 1102 and a support member 200 is bolted or otherwise fastened between the two frame plates 106 and 108 to a point on the trailer so as to provide support against the pressures which are applied in forcing the wood into position.

Various cutting edges 102, 101, 1061, 1261, 126, 128, 123 and 121, are provided when it is these cutting edges which split the wood and then allow it to be forced outward in a manner of exfoliation as is illustrated in FIG. 9 which will be described below.

In FIG. 6 it will be noted that there will be certain irregular edges of the log 130 which will not be formed into the uniform rectangular shape pieces of the other cutting edges. This of course will depend upon the exact size and shape of the log.

In FIG. 8 there is shown an auxiliary hydraulic cylinder 59 working with hydraulic cylinder 51 and ram end plate 52 to stabilize the plate 52 against any irregularities in pressure. This is an important feature.

FIG. 8 also illustrates an alternative configuration of the blade 201 on plates which are used for cutting which are attached to the main frame and plates 105 and 106. I found that by curving the edge of these blades the necessary pressure is greatly reduced in order to accomplish the end desired.

FIG. 8 also shows the manner in which the entire mechanism is bolted to the trailer at 400.

FIG. 9 illustrates the exfoliation effect achieved wherein log portions 21, 22, 23 and the like are split by various knife edges 126 and the like. Because of the staggered blades, when the log element 30 is completely in place it is desirable to have an auxiliary interior ram 53 which comes forward at the end of the stroke of the ram 51 and forces the last piece out so that all of the wood of the particular log has been split appropriately.

It may be that portion 21, as shown in FIG. 9 may have an irregular shape and be smaller than the other pieces therefore it will either be discarded or used separately and not boxed in the manner shown in FIG. 11. FIG. 11 illustrates the desirability of this type of forming of the wood. A strap 80 is shown in one direction around the wood and, of course there will be a like strap, not shown for purposes of clarity, going the other direction so as to hold all of the bottom pieces of the wood in shape in the "boxed" configuration.

Figure 12:
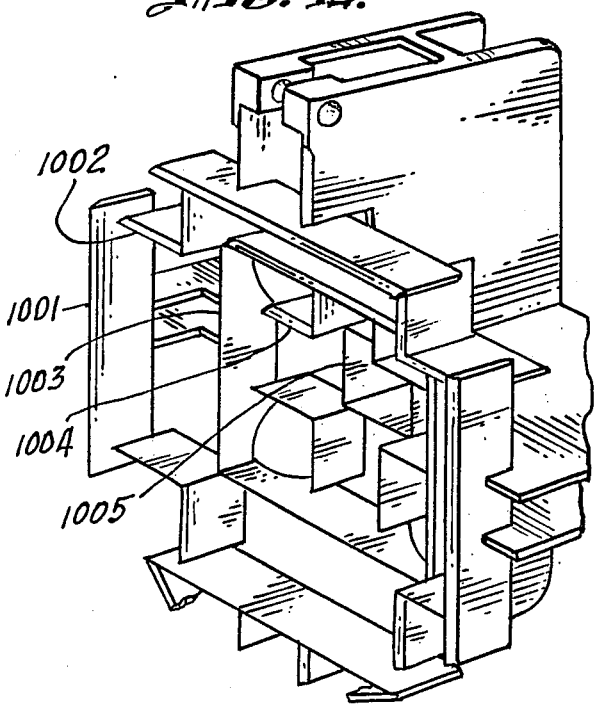
FIG. 12 is a view of an alternate embodiment of the cutting elements.

FIG. 12 shows an arrangement quite similar to FIG. 8, but in which the cutting edges are slightly differently arranged and are beveled as at 1001, 1002, 1003, 1004, 1005 and the like. These beveled edges are shown to have a bevel which tends to force the wood as it is split outwardly away from the knife. In this way jamming is absolutely eliminated and the wood itself as shown in FIG. 9 even more dramatically than with plain knife edges.

Figure 13:
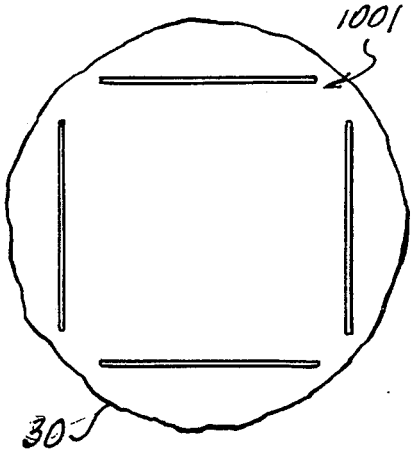
FIGS. 13, 14, 15, 16 and 17 are individual drawings illustrating the arrangement of the cutting element.

FIG. 13 shows the outermost cutting edges at 1001 which essentially take off and square up the round log.

Figure 14:
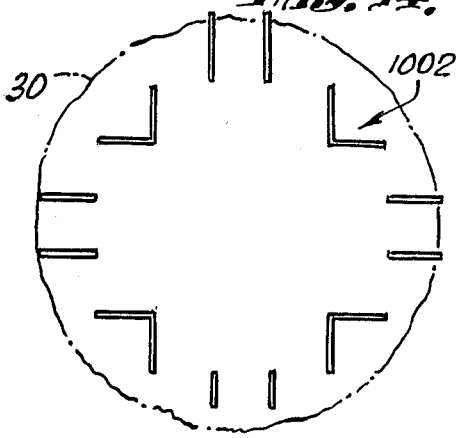

FIG. 14 shows the cutting edges of the next series of blades as at 1002 and indicates how they will be restricting the condition of the wood which comes from the log 30.

Figure 15:
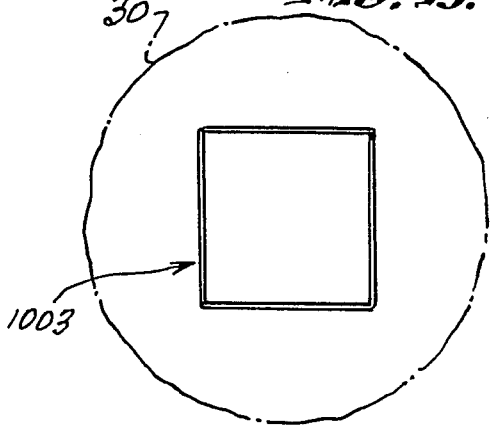

FIG. 15 shows an inner configuration of a square block of the blade 1003.

Figure 16:
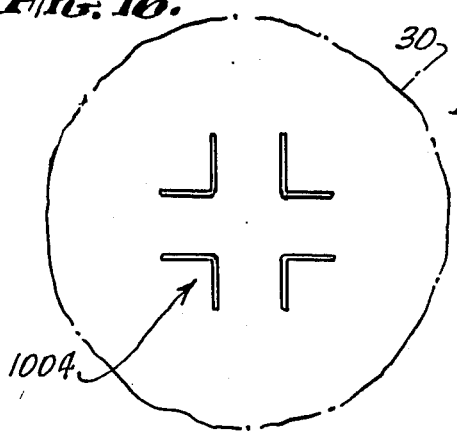

FIG. 16 shows the next series of blades 1004 which will be within and causing the cutting from 1003.

Figure 17:
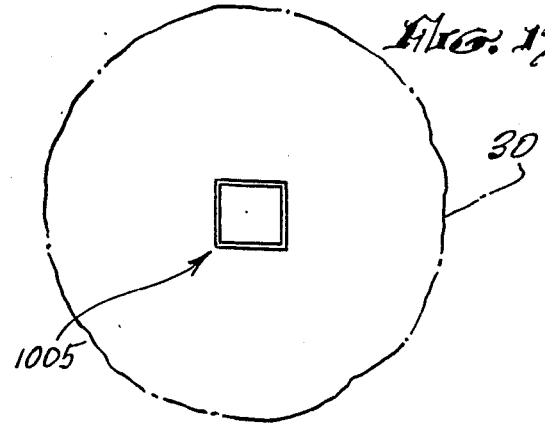

FIG. 17 shows the final core blade 1005 which will be the final cut which passes directly through the center.

Figure 18:
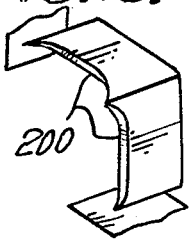
FIG. 18 is an alternative embodiment of the shape of each of the knife cutting elements.

FIG. 18 shows a desirable alternative of the wedge shaped knives at 200. In this case the knives have been curved as well as beveled so that there is a gradual cutting into the piece. It will be clear from FIG. 18 how each series of cuts is caused, by the beveled edges, to be forced outwardly. If this were not true, the center piece, as being cut by blade edges 1005, would have a tendency to jam since great pressure would be placed against the exterior side of the box like element at 1105 if it was a straight cut. However being beveled from the outer edges, such pressure does not exist since the center cut is relieved of those pressures and passed through the knives cleanly.

Upon completion of the splitting of one piece of log as at 30, the remainder of the log (referring back to FIGS. 1 through 4) will be moved forward by the chain 80, will be cut by the chainsaw or the like 60 which extends under the log as shown in FIG. 2, and a new block 30 will be in place for further splitting. The action of the hydraulic ram and its return is very rapid so that little time is lost between passes of the ram and the formation of different segments has been made.

While the embodiments of this invention shown and described are fully capable of achieving the objects and advantages desired, it is to be understood that such embodiments have been shown for purposes of illustration only and not for purposes of limitation.

I claim:

1. The method of cutting firewood from a large log comprising: (1) moving a log along the bed of a trailer toward a log; (2) Cutting a predetermined length of the log; (3) moving the predetermined length of the log into a position between a multiple splitting device and a first hydraulic ram; (4) activating said hydraulic ram so as to push said cut portion of log through the multiple cutting device thus splitting the log into a multiplicity of relatively evenly shaped rectangular pieces of wood; () withdrawing the ram to be in position to receive a second cut portion of log; and (6) advancing a second hydraulic ram through the first hydraulic ram so as to force the last portion of the log through the cutting device before the second log portion is cut.

2. The method of claim 1 wherein a third hydraulic ram is advanced against a face plate attached to the first hydraulic ram to equalize pressure in the event the surface pressure shall be uneven.

3. The method of claim 2 wherein upon completion of the cutting of the wood into relatively uniform rectangular pieces, the rectangular pieces are stacked together and strapped in the form of a box.

4. An apparatus for cutting firewood from large logs comprising a multiplicity of cutting blades defining a multiplicity of rectangular shaped cutting edges; means to support said multiplicity of rectangular cutting edges on a frame; means associated with said frame to push a log section of wood against said cutting edges, which cutting edges are wedged shaped and staggered with relation to each other so as to aid in expelling the wood being forced past them in that the staggering of the blades and the wedge shape causes an exfoliation effect with the wood being forced past the cutting edges as uniformly shaped rectangular pieces and wherein the means to push the log section against the cutting edges comprising an hydraulic ram consisting of a cylinder, a first cylinder rod which is hollow and in turn takes the hydraulic pressure when the hollow rod has reached its full extension and a second cylinder rod within the first cylinder rod which advances forward against a smaller portion of the center of said log section.

5. The apparatus of claim 4 wherein the leading edge of each of said cutting edges is curved so as to provide a slicing action.

* * * * *